United States Patent [19]

Beardmore

[11] 4,317,541

[45] Mar. 2, 1982

[54] FUEL INJECTOR-PUMP UNIT WITH HYDRAULIC NEEDLE FUEL INJECTOR

[75] Inventor: John M. Beardmore, Howell, Mich.

[73] Assignee: General Motors Corporation, Detroit, Mich.

[21] Appl. No.: 167,231

[22] Filed: Jul. 10, 1980

[51] Int. Cl.[3] ..... B05B 1/30

[52] U.S. Cl. ..... 239/88; 239/533.3

[58] Field of Search ..... 239/88, 89, 90, 533.3–533.12

[56] References Cited

U.S. PATENT DOCUMENTS 2,898,051 8/1959 Teichert ..... 239/88 X 2,951,643 9/1960 Engel ..... 239/90

4,054,248 10/1977 Beardmore ..... 239/88

*Primary Examiner*—Robert B. Reeves

*Assistant Examiner*—Gene A. Church

*Attorney, Agent, or Firm*—Arthur N. Krein

[57] ABSTRACT

A jerk type fuel injector-pump unit has a hydraulic needle fuel injector and a plunger rotatably and reciprocably journaled in a bushing to supply pressurized fuel to the injector with a feed-bleed hydraulic circuit incorporated in the plunger and wall of the bushing to control operation of the hydraulic needle whereby to control injection timing.

4 Claims, 1 Drawing Figure

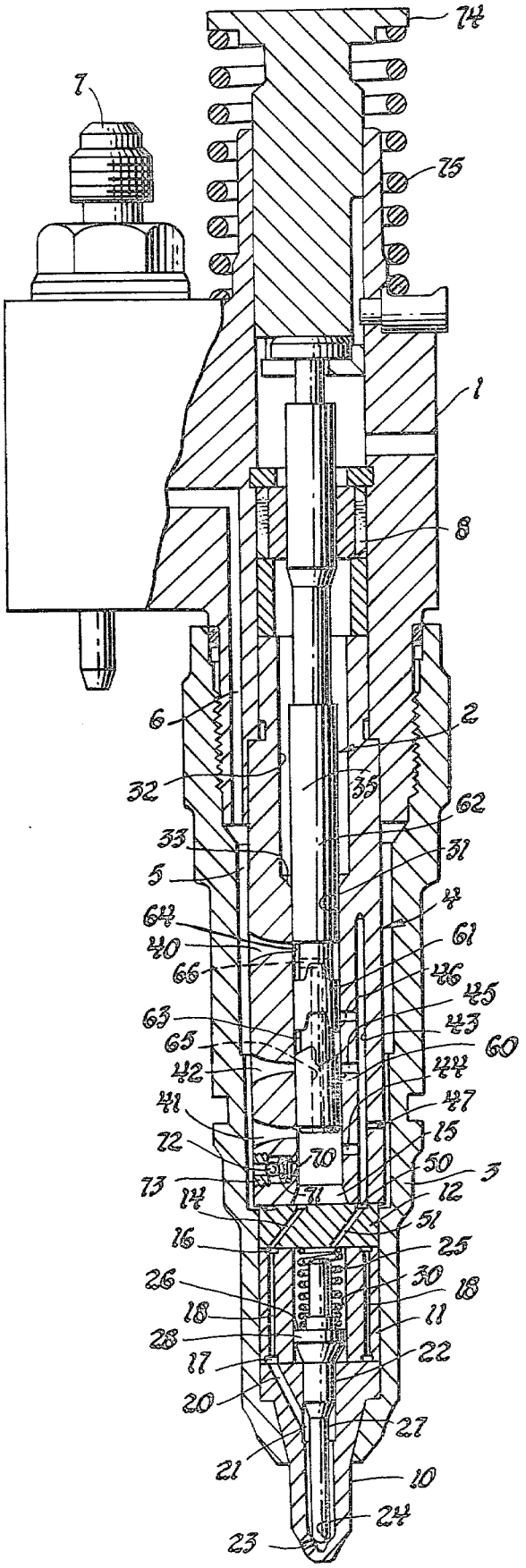
74
7
75
1
8
6
2
32
35
62
33
31
5
4
64
61
40
66
46
45
63
43
65
60
42
44
41
47
72
15
70
50
3
73
71
12
14
51
16
25
26
30
18
18
11
28
22
17
20
27
21
10
24
23

FUEL INJECTOR-PUMP UNIT WITH HYDRAULIC NEEDLE FUEL INJECTOR

FIELD OF THE INVENTION

This invention relates to pressure fluid injectors, and particularly to those of the so-called "jerk" type for the injection of liquid fuel into the cylinder of an internal combustion engine. In particular, this invention relates to such an injector having a plunger-bushing arrangement to control the operation of its hydraulic needle fuel injector.

DESCRIPTION OF THE PRIOR ART

It is well known that conventional jerk-type fuel injector-pump units, because of their mode of operation, generate noise. In such injector-pump units, there are two phases during the injection operating cycle of such a unit which relate directly to the creation of such noise, namely, the beginning and end of injection. Thus, noise is generated because of the pressure rate development within the unit injector and because of the high pressure release in the injector at the end of injection.

In Applicant's U.S. Pat. No. 4,054,248 entitled "Fuel Injector Pump For A Unit Fuel Injector" issued Oct. 18, 1977 to Applicant, John M. Beardmore, there is disclosed an arrangement that is operative to eliminate sudden plunger force changes at the start and end of injection so as to reduce the noise generation within the unit.

This injector-pump unit also had a hydraulic needle injector incorporated therein that operates quieter than a standard type injector, because in the first mentioned injector, high injection pressures are utilized to slam the hydraulic needle closed for a sharp end of injection (E.O.I.). However although in this unit a sharp end of injection was obtained, this only occurred at the end of pressurized fuel flow from the pump chamber.

SUMMARY OF THE INVENTION

Accordingly, it is a primary object of this invention to provide an improved pump plunger and bushing arrangement in a jerk-type, fuel injector-pump unit having a hydraulic needle type injector whereby the unit is operative to provide for both a very sharp start of injection (S.O.I.) and end of injection (E.O.I.) without shock loading the injector train.

A further object of this invention is to provide an improved jerk-type, fuel injector-pump unit in which the pump plunger and bushing portion of such a unit has a feed-bleed hydraulic circuit incorporated therein whereby to control the operation of the hydraulic needle fuel injector portion of the unit.

A still further object of this invention is to provide a fuel injector-pump unit with an improved plunger and bushing arrangement therein utilized to supply fuel to and control operation of the hydraulic needle injector of the unit.

These and other objects of the invention are obtained in a fuel injector-pump unit of the type having a bushing positioned in an injector housing to form therewith an annular fuel supply chamber encircling the bushing intermediate the ends thereof and having a plunger axially and reciprocably positioned in the bushing, effecting a pumping stroke and a suction stroke, for supplying fuel to the hydraulic needle injector of the unit, the plunger and bushing, in accordance with the invention, defining a feed-bleed hydraulic circuit to control injection timing via the hydraulic needle valve of the injector.

For a better understanding of the invention, as well as other objects and further features thereof, reference is had to the following detailed description of the invention to be read in connection with the accompanying drawings, wherein:

BRIEF DESCRIPTION OF THE DRAWINGS

The FIGURE is a longitudinal sectional view through a unit injector-pump assembly having incorporated therein a hydraulic needle injector and a plunger-bushing structure in accordance with a preferred embodiment of the invention, the plunger thereof being shown at the beginning of plunger stroke position.

DESCRIPTION OF THE EMBODIMENT

Referring now to the FIGURE, there is shown a unit injector-pump assembly having a housing 1 in which a plunger 2, to be described in detail hereinafter, is rotatably and reciprocably positioned. Forming an extension of and threaded to the lower end of the housing 1 is a nut 3 within which is supported the lower end of a bushing 4, to be described in detail hereinafter, providing a pump cylinder structure for the plunger 2. An annular fuel chamber 5, encircling the bushing 4 within the nut 3, is supplied with fuel, at a suitable supply pressure, via passages 6 in the housing from an external fuel connection 7 in a well-known manner.

Clamped to the lower end of the bushing 4 by the nut 3 is a fuel injector or nozzle assembly, including a valve body comprising a spray tip 10, a valve spring cage 11 and a spacer block 12.

The spacer block 12 has an inclined passage 14 having one end thereof facing the cylinder opening or outlet 15 at the lower end of the bushing 4. The opposite end of the inclined passages 14 provided in the spacer block 12 opens into an annular groove 16 in the upper end of the valve spring cage 11. This groove 16 is connected with a similar annular groove 17 on the bottom face of the valve spring cage 11 by one or more longitudinal passages 18 through the valve spring cage. The lower groove 17 is, in turn, connected by one or more inclined passages 20 to a central chamber or passage 21 surrounding a hydraulic needle valve 22 reciprocably positioned within the spray tip 10. At the lower end of this passage 21 is an outlet for fuel delivery in the form of one or more spray orifices 23 in the spray tip end of the spray tip 10. A conical valve seat 24 encircles the lower portion of passage 21 upstream of spray orifices 23.

The needle valve 22 is normally biased to a closed position in abutment against the valve seat 24 by a coil spring 25 positioned in the valve spring cage 11, with one end thereof in abutment against the lower surface of the spacer block 12 and its other end abutting against a spring seat 26 which can be a separate element or formed integral, as shown, with the needle valve. The piston portion 28 of the needle valve 22 slidably fits in the upper end of the bore defining the passage 21 in the spray tip and has its lower end, with the valve stem 27 depending therefrom, exposed to fuel pressure in the passage 21 and its upper end is exposed to fuel pressure in the spring chamber defined by the cylindrical wall 30 in valve spring cage 11 formed concentric with the passage 21 in spray tip 10.

Other details of the upper portion of the unit fuel-pump assembly are not important to the present invention, and are common to the construction shown and described in such prior art patents as U.S. Pat. No. 2,951,643 entitled "Fuel Injector with Pilot Injection" issued Sept. 6, 1960 to Royce G. Engel, Jr. and U.S. Pat. No. 2,898,051 entitled "Fluid Injection Device" issued Aug. 4, 1959 to Conrad A. Teichert and, hence, will not require further description here.

Referring now to the subject matter of the invention, the bushing 4 is provided with a stepped bore therethrough to define at one end thereof, the lower end with reference to the FIGURE, a pump cylinder 31 with the outlet 15 at one end thereof and, in the construction shown, an enlarged diameter portion 32 at its upper end. Cylinder 31 and portion 32 are interconnected by a shoulder 33.

The plunger 2, rotatably and reciprocally journaled in the bushing 4, includes a lower piston 35 portion of a suitable diameter so as to be reciprocably journaled in the pump cylinder 31 of the bushing to form therewith a pump chamber used to effect delivery of fuel under pressure via outlet 15 to the fuel injector nozzle assembly of the unit injector.

Again referring to the bushing 4, it is provided with an upper side port 40, a lower side port 41 and an intermediate side port 42 to permit fluid communication between the pump cylinder 31 and the annular fuel space 5. Upper and lower side ports 40 and 41 may be referred to as fill ports, while intermediate side port 42 can be termed a spill port, to indicate their respective function during operation of the unit as described hereinafter.

Now, in accordance with a feature of the invention, bushing 4 is also provided with an axial passage 43 in the wall thereof radially outward of cylinder 31, that extends upward from the bottom of the bushing 4 a predetermined axial distance.

Passage 43 is interconnected to cylinder 31 by a lower side control port 44, an intermediate side control port 45 and upper side control port 46 and this passage 43 is interconnected by a bleed orifice port 47 of a predetermined size to the fuel chamber 5, all for a purpose to be described. Bleed orifice port 47 is preferably sized so as to be approximately equal to the total flow area of the spray orifices 23 for a purpose which will be understood as the operation of the unit is described hereinafter.

The lower end of passage 43 opens into an annular groove 50 provided in the upper surface of spacer block 12. This groove 50 is in flow communication with one end of an inclined passage 51 provided in the spacer block 12, so that the opposite end of passage 51 opens into the upper end of the cavity defined by wall 30 in the spring cage 11.

The piston 35 portion of plunger 2 is provided with the spaced apart lower, intermediate and upper lands 60, 61 and 62, respectively. An external annular metering groove 63, of predetermined width is provided between lower land 60 and intermediate land 61 and another annular groove 64 of a predetermined width is provided between intermediate land 61 and upper land 62 by which opening and closing of ports 41, 42 and 40 and of the control ports 44, 45 and 46 in the bushing 4 are controlled. An axial passage 65 extends upward from the bottom of plunger 2 to connect with a transverse passage 66, for bypassing fuel from the lower end of plunger 2 to the groove 64, for a purpose to be described.

As is well known and in accordance with conventional practice, the metering groove 63 has the lower edge portion or control edge of the intermediate land 61 and the upper edge portion or control edge of the lower land 60 each inclined, as desired, helically of the axis of plunger 2. In addition, the upper edge or control edge of the intermediate land 61 is inclined, as desired, helically of the axis of plunger 2. In the construction illustrated, the opposite control edges of the intermediate land 61 are formed complimentary to each other. The lower edge of the upper land 62 is straight in the embodiment illustrated.

Preferably, as shown in the embodiment illustrated, bushing 4 is also provided at its lower end with a stepped bore passage or fill port 70 formed in the side wall thereof so as to open through the cylinder wall 31 at a location at or below the plunger 2 stroke depth therein whereby to provide fluid communication between this portion of the pump chamber and fuel chamber 5. A suitable one-way check valve, such as spring 71 biased ball check valve 72 adapted to seat on an apertured valve seat element 73, secured as by threaded engagement in one end of passage 70, is used to control fuel flow from the fuel chamber 5 into the pump chamber in the manner to be described.

As is well known, the plunger 2 is axially rotatable by means of a pinion 8 on the plunger and by a rack, not shown, to thereby regulate injection timing and to regulate the fuel charge per cycle, as desired. Also as well known, each downward or pumping stroke of the plunger 2 from its position shown is effected by means of, for example, an engine rocker, not shown, engaging the follower 74 while the return stroke thereof is effected by means of a return spring 75.

As shown, the lower port 41 is axially spaced from the bottom of the bushing 4 so that when the plunger 2, is positioned, as shown, at the beginning of its stroke, this port is uncovered at that time by the lower land 60. Upper port 40 and intermediate port 42 are each longitudinally spaced from lower port 41 a predetermined distances correlated with the axial spacing of the control edges of lands 60, 61 and 62 of plunger 2 and the normal length of the working stroke of the plunger.

Also as shown, the lower control port 44 is axially spaced a predetermined distance from the bottom of bushing 4 and therefore from the bottom of plunger 2, when the plunger is at the beginning of its stroke, as shown, whereby this control port is uncovered at that time and for a predetermined period during the downward pump stroke of the plunger. Intermediate and upper control ports 45 and 46, respectively, are each longitudinally spaced from lower control port 44 and these spacings are also correlated to the spacing of the control edges of lands 60, 61 and 62, all to provide the feed-bleed flow of fluid in the feed-bleed hydraulic circuit described whereby to control operation of the needle valve 22 in a manner to be described.

In the operation of the injector-pump unit shown, when the plunger 2 is at the top of its stroke, the position shown, the upper port 40 and lower port 41 to the cylinder 31 are open, permitting a change of fuel, for example at a supply pressure of 50 psi, to enter the variable volume pump chamber as formed by the lower end of plunger 2 and cylinder 31. As shown, lower port 41 is in direct communication with the pump chamber, while upper port 40 is in fluid flow communication therewith via groove 64 and passages 66 and 65 in plunger 2. At the same time, lower control port 44 to passage 43 is open. Of course, the bleed orifice port 47 is open during all phases of operation. With these ports thus being open at this time, the pump chamber and the hydraulic circuit to the needle valve 22 are charged with fuel at the supply pressure, that is, at 50 psi in this example.

Beginning of Plunger Motion

As the plunger 2 begins to move on a pump stroke, downward with reference to the FIGURE, both upper and lower ports 40, 41, respectively, are simultaneously closed, thereby trapping fuel below the plunger 2 within the pump chamber. Pressure within the pump chamber then begins to develop, increasing with plunger movement the velocity of which increases in a known manner. Since the lower control port 44 to passage 43 remains open for a predetermined period of time during this initial downward movement of the plunger 2, equal fuel pressure will be applied to both ends of the needle valve 22, that is, the fuel pressure in passage 21 and in spring chamber defined by wall 30 in the valve spring cage 11, will be equal. Since, as shown, the effective area of the piston portion 28 at the upper end of the needle valve 22 is greater than at the lower portion of this valve, the needle valve 22 will remain closed. Of course, the bias of spring 25 is also operative at this time to keep the needle valve 22 closed.

Start of Injection

Start of injection is initiated when the plunger 2 moves downward to a position at which its land 60 closes the lower control port 44, while the upper control edge of this land 60 simultaneously opens the intermediate bleed port 42 and intermediate control port 45. This allows the bleed of pressure in the hydraulic circuit to the spring chamber in the spring cage 11, acting on one end of the needle valve 22, to fuel supply pressure. This, then allows the high pressure fuel discharged via outlet 15 from the pump chamber to passage 21 to effect opening movement of the needle valve 22. Injection then begins as fuel is discharged through the spray orifices 23.

End of Injection

As the plunger 2 continues its downward movement, the lower control edge of land 61 will close intermediate control port 45 as well as intermediate port 42, while the upper control edge of this land 61 will simultaneously, in the embodiment shown, open the upper control port 46. As this occurs, the pressure of fuel in the pump chamber communicates via passages 65 and 66, and groove 64 to the needle valve control circuit via the now open upper control port 46. This allows high pressure fuel flowing into the spring chamber to act on the piston portion 28 on the upper end of the needle valve 22, as assisted by the force of spring 25, to effect seating of this needle valve against the valve seat 24 to end injection.

Bottom of Plunger Stroke

After the end of injection, the plunger 2 continues on its downward stroke, at near maximum velocity, displacing fuel via passages 65, 66, groove 64, upper control port 46 and passage 43 out through the bleed orifice port 47 to the fuel chamber 5 until the bottom of the plunger stroke. Thus, the plunger load decreases gradually, as controlled by the size of the bleed orifice port 47.

Plunger Return Stroke

During the return upward stroke of the plunger 2, as effected by the spring 75, to the position shown, the check valve 72 controlled fill port 70 is operative to ensure rapid refilling of the pump chamber. Without the check valve 72 controlled fill port 70, a high vacuum could be created in certain applications, as the plunger returns to the top of its stroke, which could result in residual fuel in the pump chamber to vaporize and, if this occurs, it would inhibit recharging the pump chamber via the upper and lower fill ports 40, 41 respectively.

From the above description of the operation of the subject injector pump unit disclosed, it will be apparent that this device will be operative so as to have a very sharp start of injection and sharp end of injection without shock loading the injector drive train.

The embodiments of the invention in which an exclusive property or privilege is claimed are defined as follows:

1. A unit fuel injector-pump including a housing means defining a supply chamber therein connectable to a source of fuel at low pressure and a pump bushing having a pump cylinder therein; a pump plunger reciprocably in said pump cylinder; said bushing having axially spaced apart lower, intermediate and upper ports for connecting said pump cylinder with said supply chamber, with each said ports openable and closeable by the plunger during its pumping stroke, and an opening at one end of said cylinder for fuel displaced by the plunger when said ports are closed; a fuel delivery passage connected to said opening and terminating at an outlet for the discharge of fuel; an injection valve normally closing said outlet but movable to open same in response to a predetermined relatively high fuel pressure developed in said pump cylinder by said plunger; a spring chamber separate from said passage; a spring in said spring chamber and operatively connected to said valve for normally biasing said valve to close said outlet, said valve being exposed to pressure in said spring chamber acting thereon in the direction toward closure of said outlet; and, a secondary hydraulic passage connected at one end to said spring chamber and by axial spaced apart lower, intermediate and upper control ports in said bushing to said pump cylinder and by a bleed orifice port in said bushing to said supply chamber, each of said control ports being sequentially closeable and openable by said plunger during its pumping stroke; said plunger having a first grooved portion and a second grooved portion that is connected by bypass passage means in said plunger to said opening; said first groove being connectable to said intermediate port and to said intermediate control port in response to downward movement of said plunger for venting said spring chamber to said supply chamber; said upper control port being axially located whereby to be operable for supplying high pressure fuel developed in said pump cylinder to said spring chamber in response to connecting said bypass means and said second groove portion thereto after a predetermined stroke of said plunger whereby high pressure fuel is supplied to said spring chamber to force said valve closed relative to said outlet for effecting termination of injection and to then discharge pressurized fuel via said bleed orifice port to said supply chamber.

2. A unit fuel injector-pump including a housing means defining a supply chamber therein connectable to a source of fuel at low pressure and a pump bushing having a pump cylinder therein; a pump plunger reciprocably in the pump cylinder; said bushing having axially spaced apart lower, intermediate and upper side ports for connecting said pump cylinder with said supply chamber with each of said ports being openable and closeable by the plunger during its pumping stroke; said bushing having an outlet opening at one end of said pump cylinder for the discharge of fuel displaced by the plunger during a pump stroke thereof; a fuel delivery passage connected at one end to said outlet opening and terminating at its opposite end in an outlet having spray orifices therein for the discharge of fuel; an injection valve positioned for movement relative to said outlet between a closed position and movable to open same in response to a predetermined relatively high fuel pressure developed in said pump cylinder by said plunger; a spring chamber separate from said passage; a spring operatively associated with said valve to bias same to an outlet closing position; said valve being exposed to pressure in said spring chamber acting thereon in the direction toward closure of said outlet; and, a secondary hydraulic passage connected at one end to said spring chamber and by axial spaced apart lower, intermediate and upper control ports in said bushing to said pump cylinder and by a bleed orifice port in said bushing to said supply chamber, each of said control ports being sequentially closeable and openable by said plunger during its pumping stroke; said plunger having a first grooved portion adapted during plunger movement to effect fluid communication between said intermediate port and said intermediate control port; said plunger having a second grooved portion in fluid communication by bypass passage means in said plunger to said outlet opening and axially spaced from said first groove portion; said upper control port being axially located whereby to be operable for supplying high pressure fuel developed in said pump cylinder to said chamber in response to connecting said bypass means and said second groove portion thereto after a predetermined stroke of said plunger whereby to bias said valve closed relative to said outlet for effecting termination of injection and to then effect the discharge of pressurized fuel via said bleed orifice port to said supply chamber.

3. A unit fuel injector-pump including a housing means defining a supply chamber therein connectable to a source of fuel at low pressure and a pump bushing having a pump cylinder therein; a pump plunger reciprocably in the pump cylinder; said bushing having axially spaced apart lower, intermediate and upper side ports for connecting said pump cylinder with said supply chamber with each of said ports being openable and closeable by the plunger during its pumping stroke; said bushing having an outlet opening at one end of said pump cylinder for the discharge of fuel displaced by the plunger during a pump stroke thereof; a fuel delivery passage connected at one end to said outlet opening and terminating at its opposite end in an outlet having spray orifices therein for the discharge of fuel; an injection valve positioned for movement relative to said outlet between a closed position and movable to open same in response to a predetermined relatively high fuel pressure developed in said pump cylinder by said plunger; a spring chamber separate from said passage; a spring operatively associated with said valve to bias same to an outlet closing position; said valve being exposed to pressure in said spring chamber acting thereon in the direction toward closure of said outlet; and, a secondary hydraulic passage connected at one end to said spring chamber and by axial spaced apart lower, intermediate and upper control ports in said bushing to said pump cylinder and by a bleed orifice port in said bushing to said supply chamber, each of said control ports being sequentially closeable and openable by said plunger during its pumping stroke; said plunger having a first grooved portion adapted during plunger movement to effect fluid communication between said intermediate port and said intermediate control port; said plunger having a second grooved portion in fluid communication by bypass passage means in said plunger to said outlet opening and axially spaced from said first groove portion; said upper control port being axially located whereby to be operable for supplying high pressure fuel developed in said pump cylinder to said chamber in response to connecting said bypass means and said second groove portion thereto after a predetermined stroke of said plunger whereby to bias said valve closed relative to said outlet for effecting termination of injection and to then effect the discharge of pressurized fuel via said bleed orifice port to said supply chamber. The flow area of said bleed orifice port being substantially equal to the flow area of said spray orifices.

4. A unit fuel injector-pump including a housing; a bushing positioned in said housing and defining therewith a supply chamber encircling said bushing and connectable to a source of fuel at low pressure; said bushing having a pump cylinder therein with an opening at one end thereof to define an outlet from the pump cylinder; a pump plunger reciprocably in the pump cylinder; said bushing having axially spaced apart lower, intermediate and upper ports connecting said pump cylinder with said supply chamber, with each of said ports being openable and closeable by the plunger during its pumping stroke; a fuel delivery passage connected to said opening and terminating at an outlet with spray orifices therein for the discharge of fuel; an injection valve normally closing said outlet but movable to open same in response to a predetermined relatively high fuel pressure developed in said pump cylinder by said plunger; a spring operatively connected to said valve to bias same to close said outlet; a spring chamber separate from said passage; said valve being exposed to pressure in said spring chamber acting thereon in the direction toward closure of said outlet; a secondary hydraulic passage connected at one end to said spring chamber and by axial spaced apart lower, intermediate and upper control ports in said bushing to said pump cylinder and by a bleed orifice port in said bushing to said supply chamber, each of said control port being sequentially closeable and openable by said plunger during its pump and suction stroke; said plunger having a first grooved portion and a second grooved portion; said second grooved portion being in fluid communication with said opening by bypass passage means in said plunger; said first groove being connectable to said intermediate port and to said intermediate control port in response to downward movement of said plunger for venting said chamber to said supply chamber; said upper control port being axially located whereby to be operable for supplying high pressure fuel developed in said pump cylinder to said chamber in response to connecting said bypass means and said second groove portion thereto after a predetermined stroke of said plunger whereby to bias said valve closed relative to said outlet for effecting termination of injection and to then discharge pressurized fuel via said bleed orifice port to said supply chamber; and, a one-way check valve fill passage means in said plunger adjacent to said opening connecting said pump cylinder to said supply chamber.

* * * * *